US010177504B2

(12) United States Patent
Zhao

(10) Patent No.: US 10,177,504 B2
(45) Date of Patent: Jan. 8, 2019

(54) ELECTRICAL CONNECTOR HAVING A SHIELDING SHELL AND A METALLIC SHIELD WITH LENGTHENED SPRING TANGS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/860,636

(22) Filed: Jan. 2, 2018

(65) Prior Publication Data

US 2018/0191105 A1 Jul. 5, 2018

(30) Foreign Application Priority Data

Dec. 30, 2016 (CN) ..... 2016 2 1492775 U

(51) Int. Cl.

| | |
|---|---|
| ***H01R 13/6594*** | (2011.01) |
| ***H01R 24/60*** | (2011.01) |
| *H01R 107/00* | (2006.01) |
| *H01R 12/50* | (2011.01) |
| *H01R 13/6587* | (2011.01) |
| *H01R 13/6466* | (2011.01) |
| *H01R 13/6581* | (2011.01) |

(Continued)

(52) U.S. Cl.

CPC ..... *H01R 13/6594* (2013.01); *H01R 24/60* (2013.01); *H01R 13/6466* (2013.01); *H01R 13/6581* (2013.01); *H01R 13/6587* (2013.01); *H01R 13/6593* (2013.01); *H01R 23/02* (2013.01); *H01R 23/7073* (2013.01); *H01R 2107/00* (2013.01)

(58) Field of Classification Search

CPC ..... H01R 13/6587; H01R 13/6594; H01R 23/7073; H01R 13/6581; H01R 13/6593; H01R 23/02; H01R 24/60; H01R 13/6466

USPC ..... 439/607.55, 607.4, 676, 660

See application file for complete search history.

(56) References Cited

U.S. PATENT DOCUMENTS

| | | |
|---|---|---|
| 9,350,126 B2 | 5/2016 | Little et al. |
| 9,653,850 B1 | 5/2017 | Su et al. |

(Continued)

FOREIGN PATENT DOCUMENTS

| | | |
|---|---|---|
| CN | 104733923 | 6/2015 |
| CN | 104836051 | 8/2015 |
| CN | 105552618 | 5/2016 |

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes: an insulative housing having a base and a tongue; an upper and lower rows of contacts secured to the housing and exposed respectively to an upper and lower surfaces of the tongue; a shielding shell enclosing the insulative housing, the shielding shell having a pair of holes; and a metallic shield attached to the shielding shell, the metallic shield having a main part, the main part having a pair of spring tangs extending rearward through the pair of shielding shell holes, respectively; wherein the metallic shield main part is spaced a distance from the shielding shell.

5 Claims, 15 Drawing Sheets

(51) Int. Cl.
*H01R 24/00* (2011.01)
*H01R 13/6593* (2011.01)

(56) References Cited

U.S. PATENT DOCUMENTS

2014/0187094 A1* 7/2014 Zhao ..... H01R 13/6581
439/626
2015/0229077 A1* 8/2015 Little ..... H01R 12/724
439/78

* cited by examiner

ELECTRICAL CONNECTOR HAVING A SHIELDING SHELL AND A METALLIC SHIELD WITH LENGTHENED SPRING TANGS

BACKGROUND OF THE INVENTION

1. Field of the Invention

The present invention relates generally to an electrical connector including a shielding shell having a pair of holes and an outer metallic shield having a pair of spring tangs extending through the pair of holes, respectively, and more particularly to an improved arrangement to improve mechanical property of the spring tang.

2. Description of Related Art

U.S. Pat. No. 9,762,009 discloses provision of spring tangs on shielding shells or outer metallic shield. U.S. Pat. No. 9,496,653 discloses lengthening of such spring tang by way of a meandering design. U.S. Pat. No. 9,653,850 discloses an electrical connector including a shielding shell having a pair of holes and an outer metallic shield having a pair of spring tangs extending through the pair of holes, respectively.

U.S. Pat. No. 9,653,850 discloses an electrical connector including a shielding shell having a pair of holes and an outer metallic shield having a pair of spring tangs extending through the pair of holes, respectively.

SUMMARY OF THE INVENTION

An electrical connector comprises: an insulative housing having a base and a tongue; an upper and lower rows of contacts secured to the housing and exposed respectively to an upper and lower surfaces of the tongue; a shielding shell enclosing the insulative housing, the shielding shell having a pair of holes; and a metallic shield attached to the shielding shell, the metallic shield having a main part, the main part having a pair of spring tangs extending rearward through the pair of shielding shell holes, respectively; wherein the metallic shield main part is spaced a distance from the shielding shell.

DETAILED DESCRIPTION OF THE PREFERRED EMBODIMENT

Figure 1:
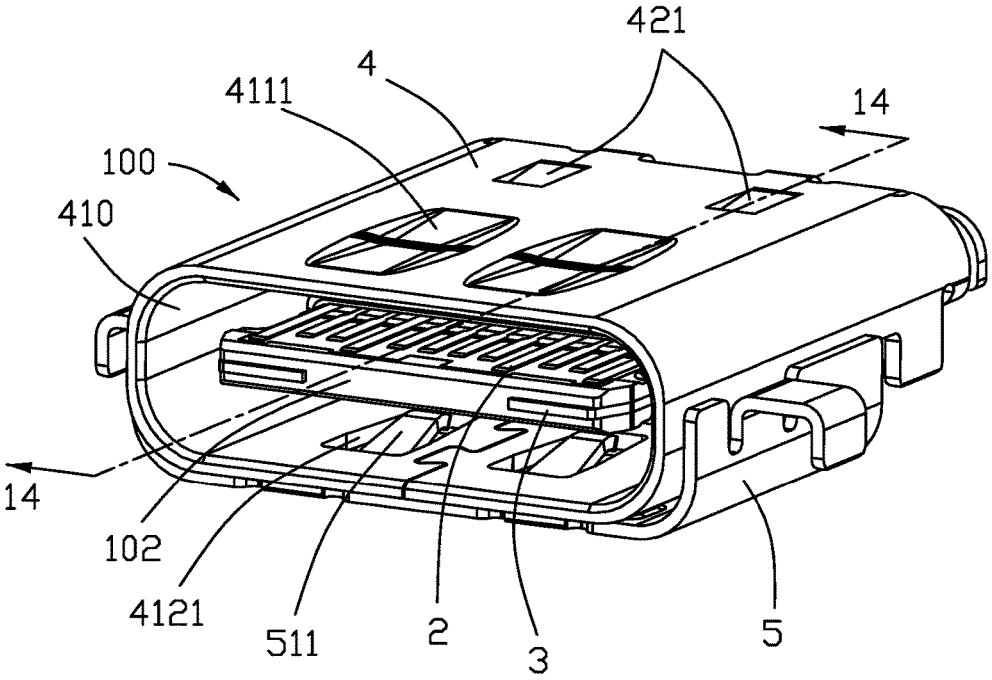
FIG. 1 is a front and top perspective view of an electrical connector in accordance with the present invention.
Figure 2:
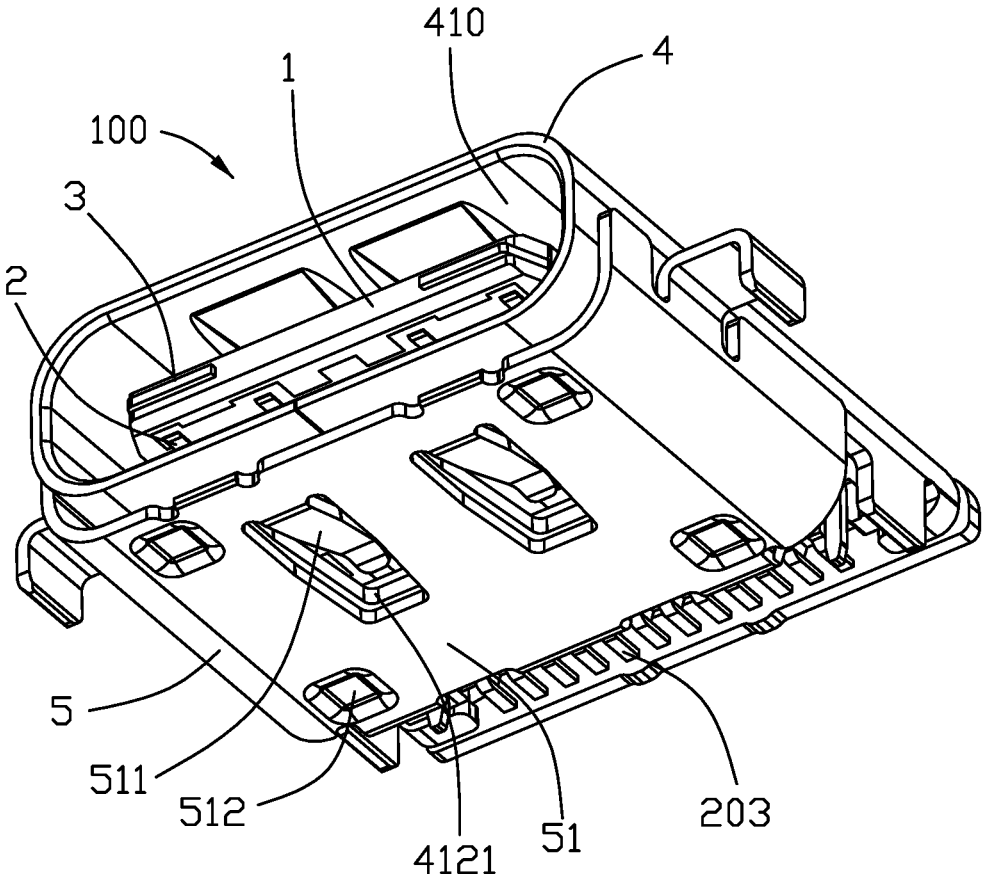
FIG. 2 is a front and bottom perspective view of the electrical connector.
Figure 3:
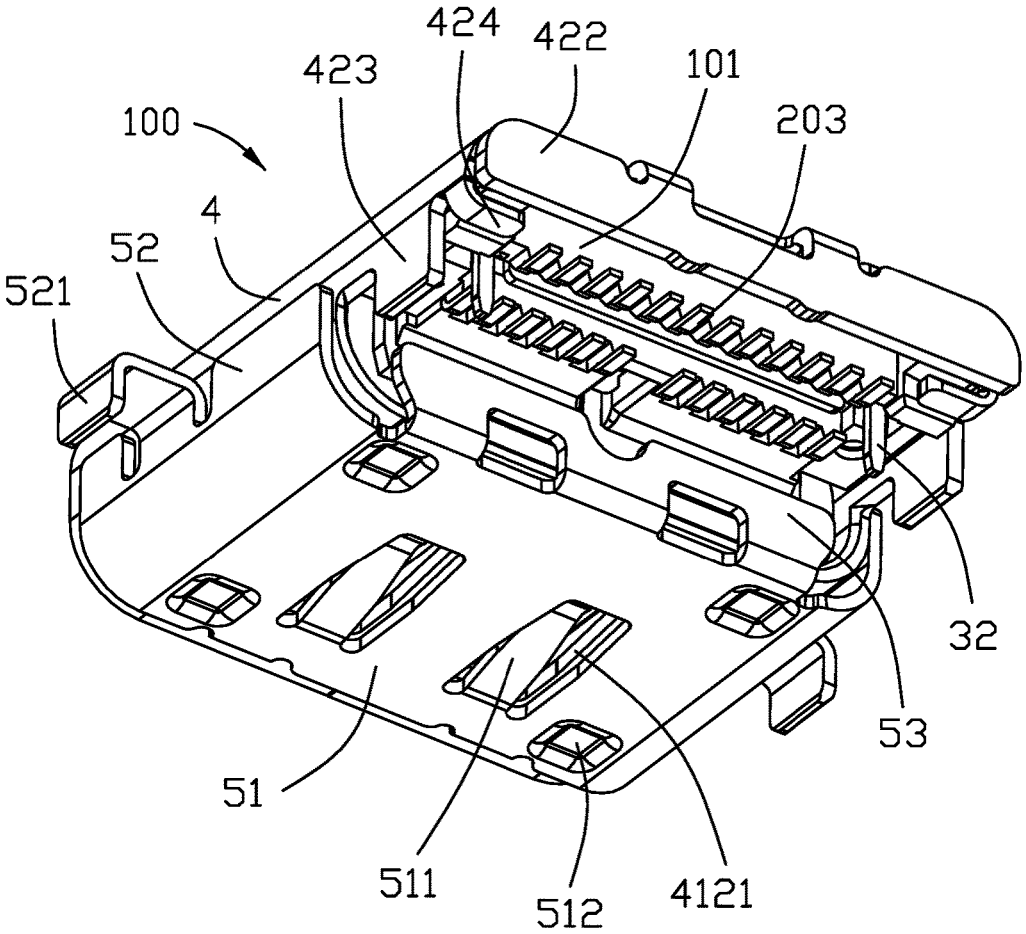
FIG. 3 is a rear and bottom perspective view of the electrical connector.
Figure 4:
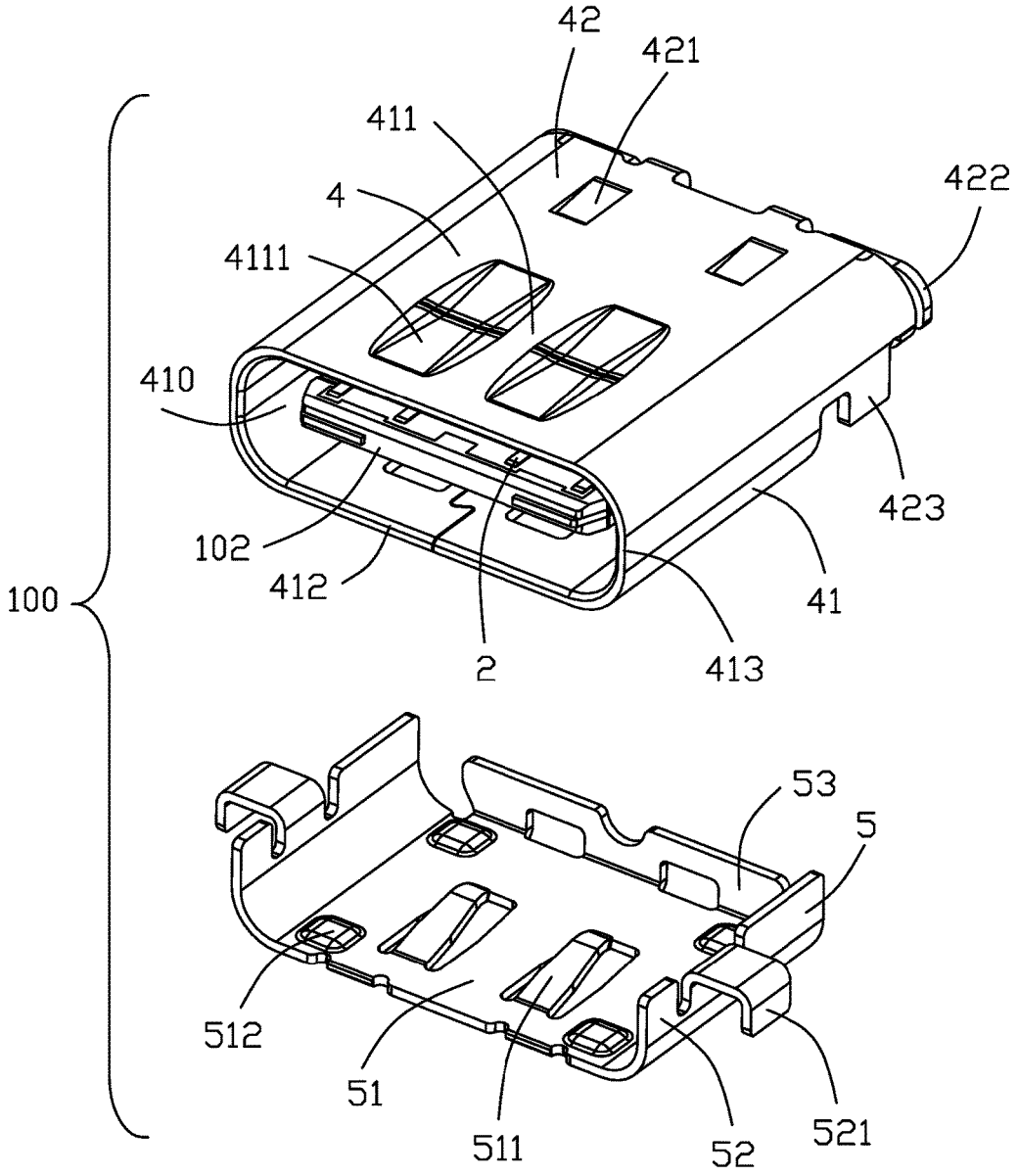
FIG. 4 is an exploded view of the electrical connector.
Figure 5:
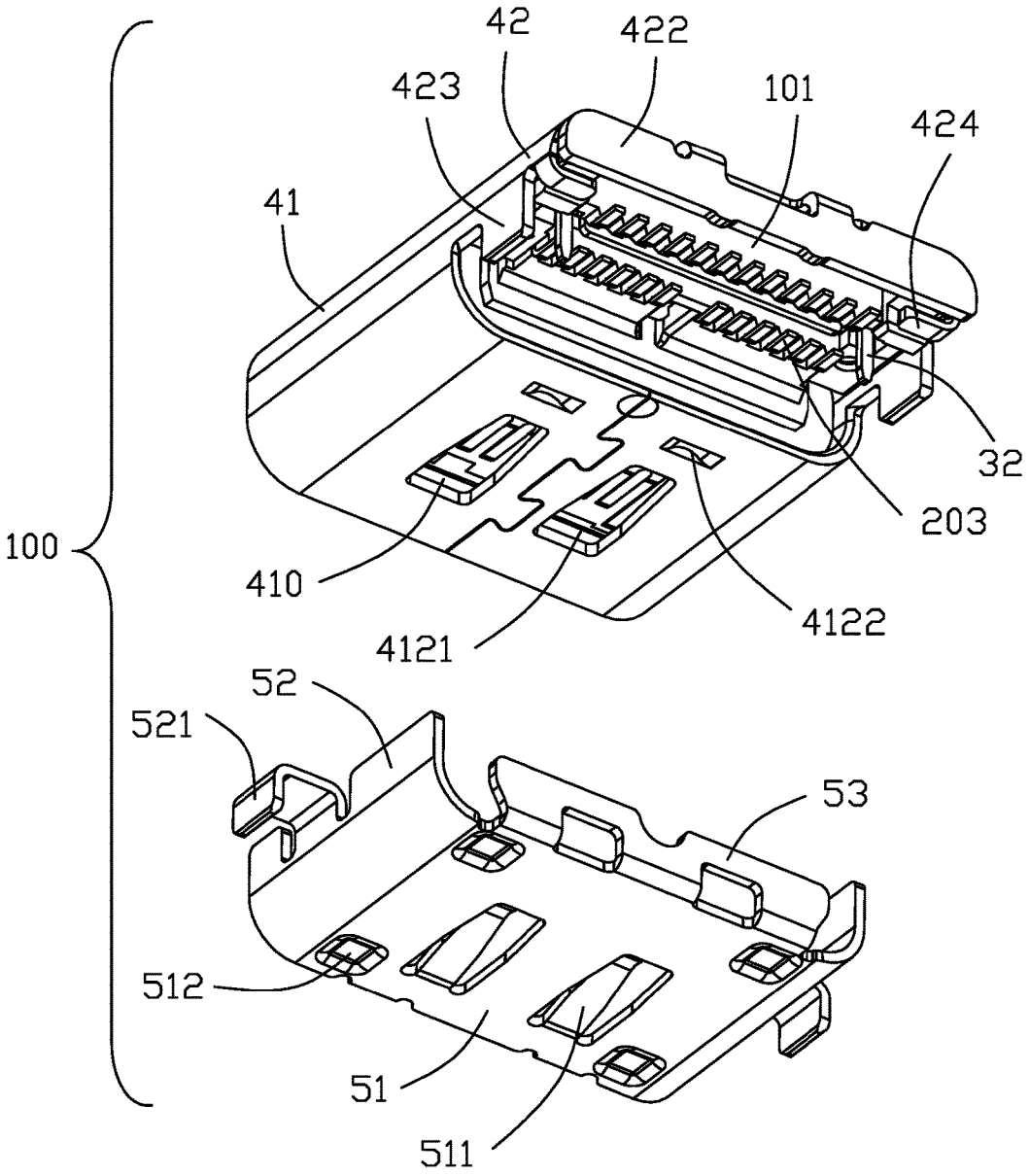
FIG. 5 is a view similar to FIG. 4 but from a different perspective.
Figure 6:
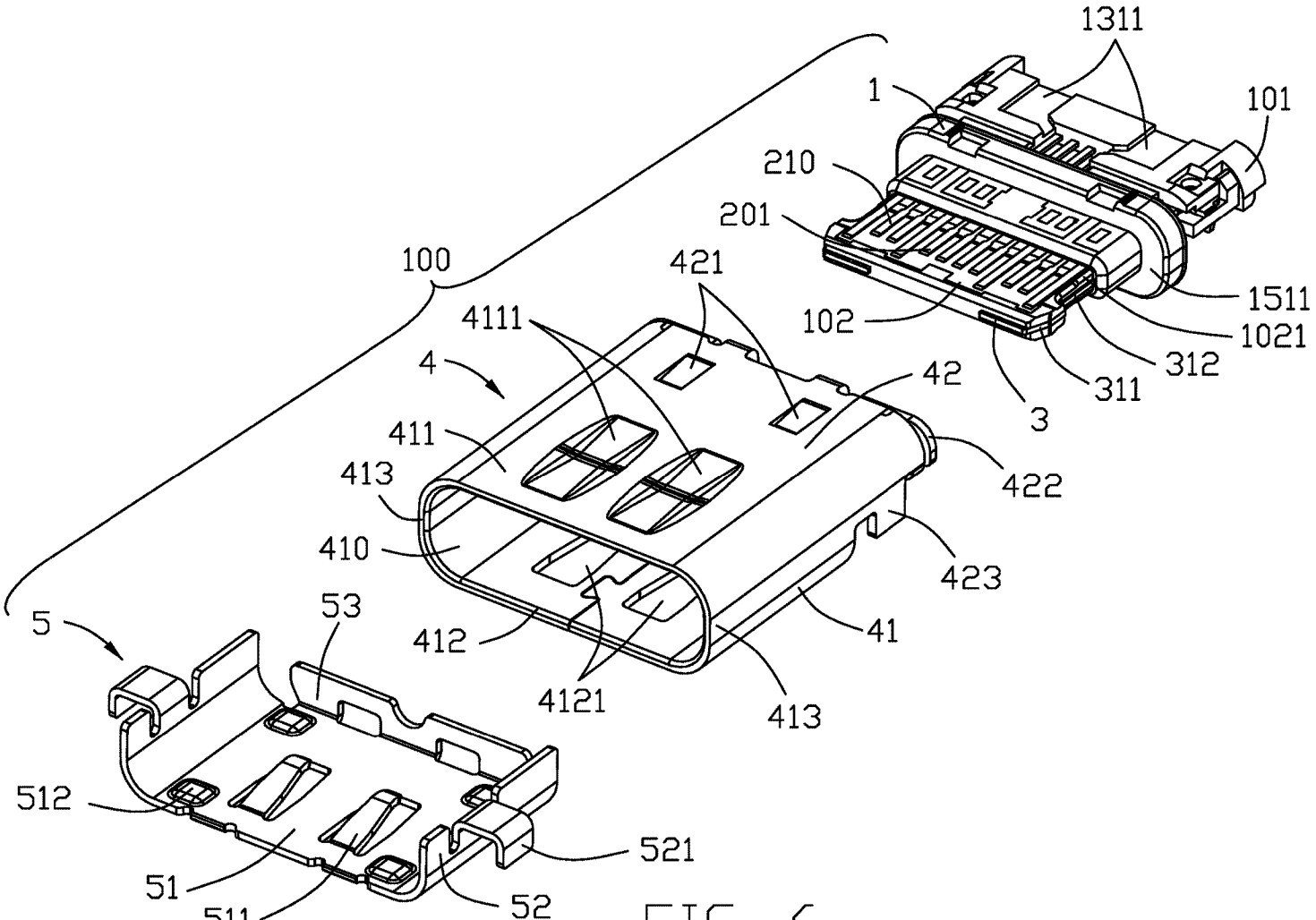
FIG. 6 is a further exploded view of FIG. 4.
Figure 7:
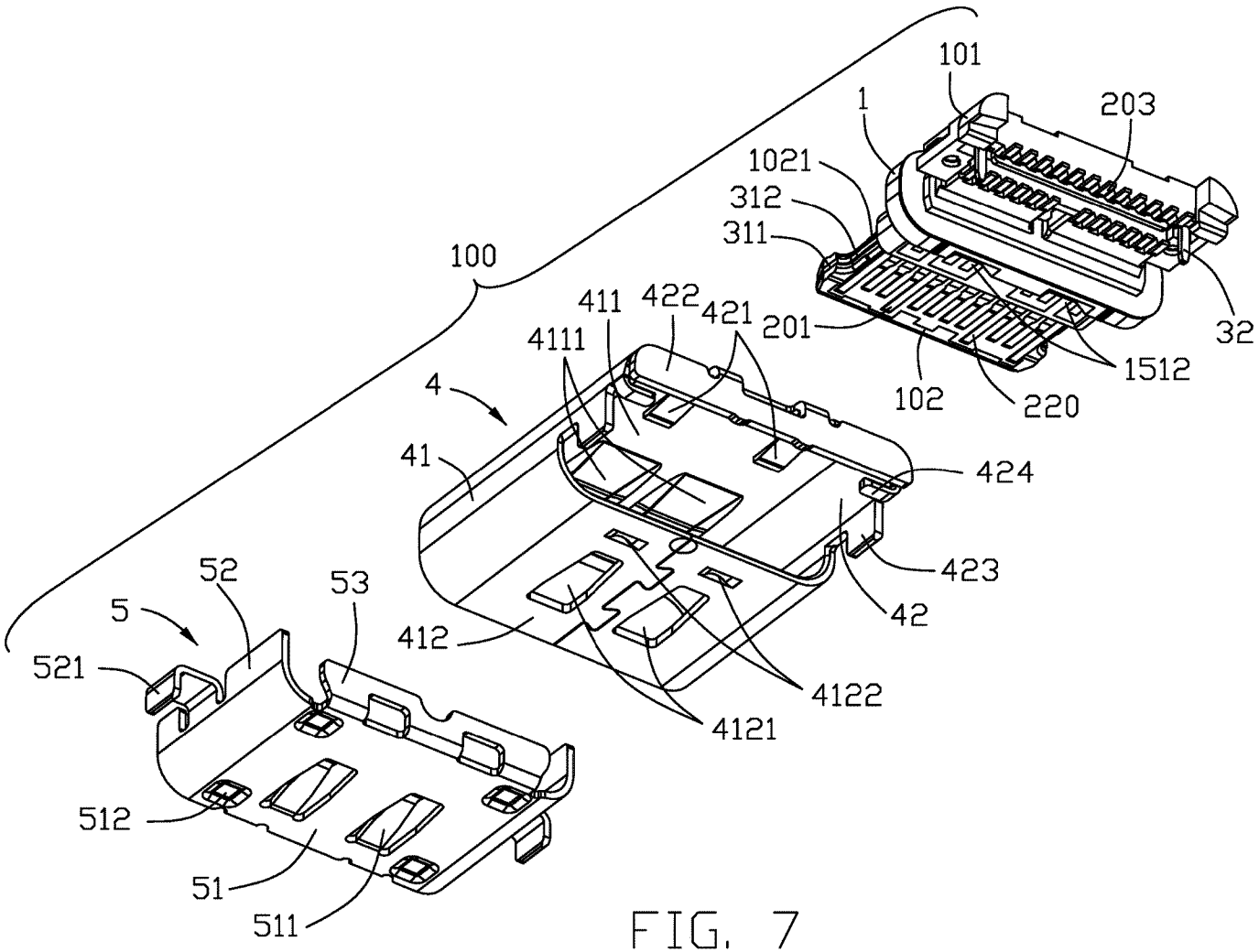
FIG. 7 is a view similar to FIG. 6 but from a different perspective.
Figure 8:
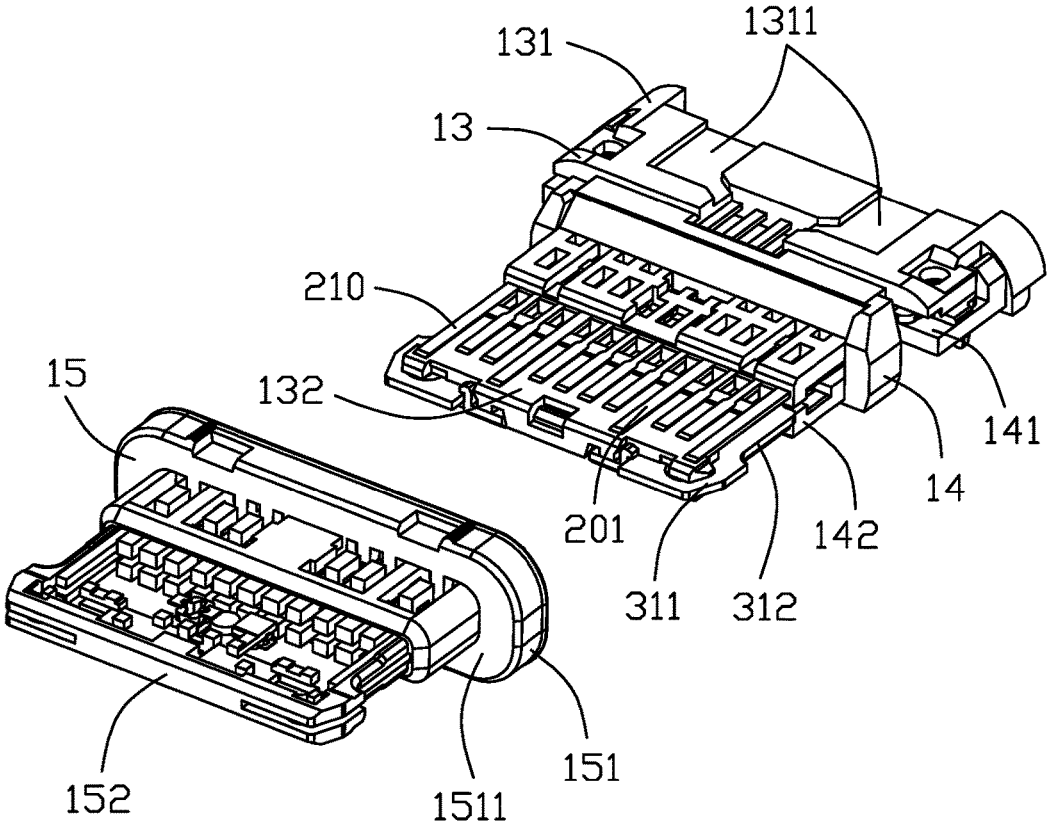
FIG. 8 is an exploded view of an insulative housing and a plurality of contacts of the electrical connector.
Figure 9:
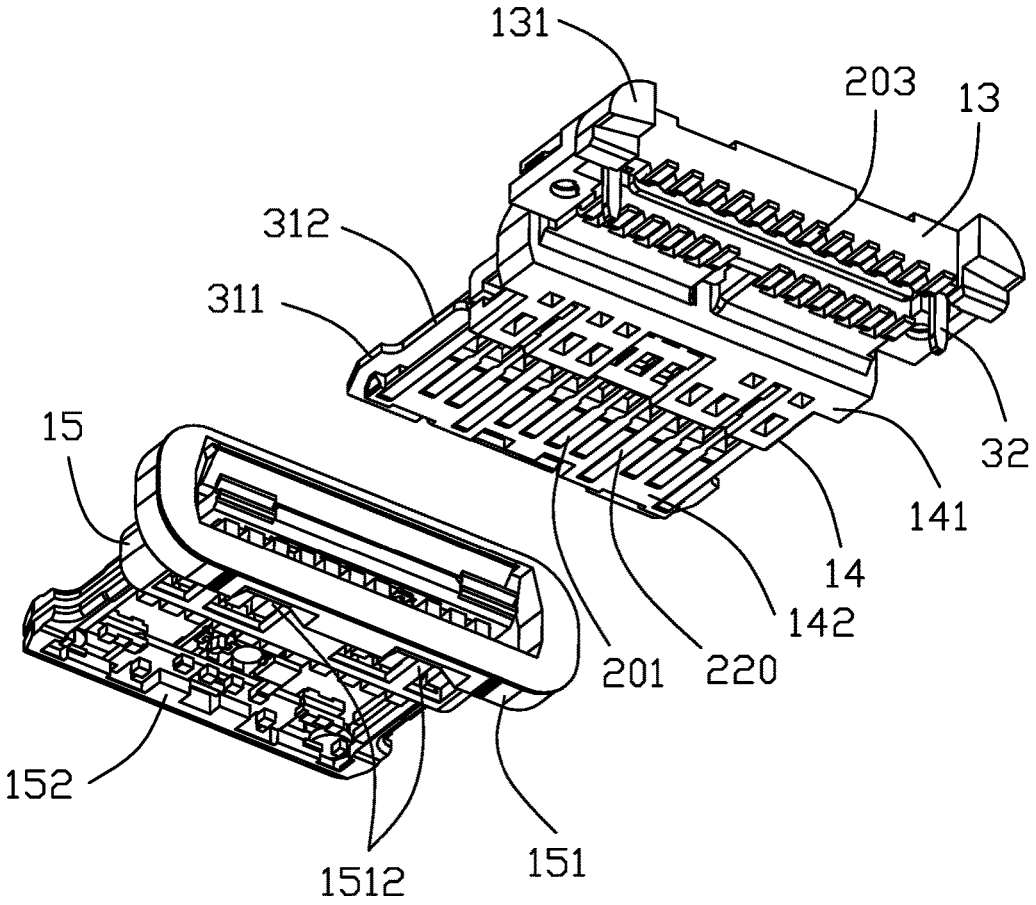
FIG. 9 is a view similar to FIG. 8 but from a different perspective.
Figure 10:
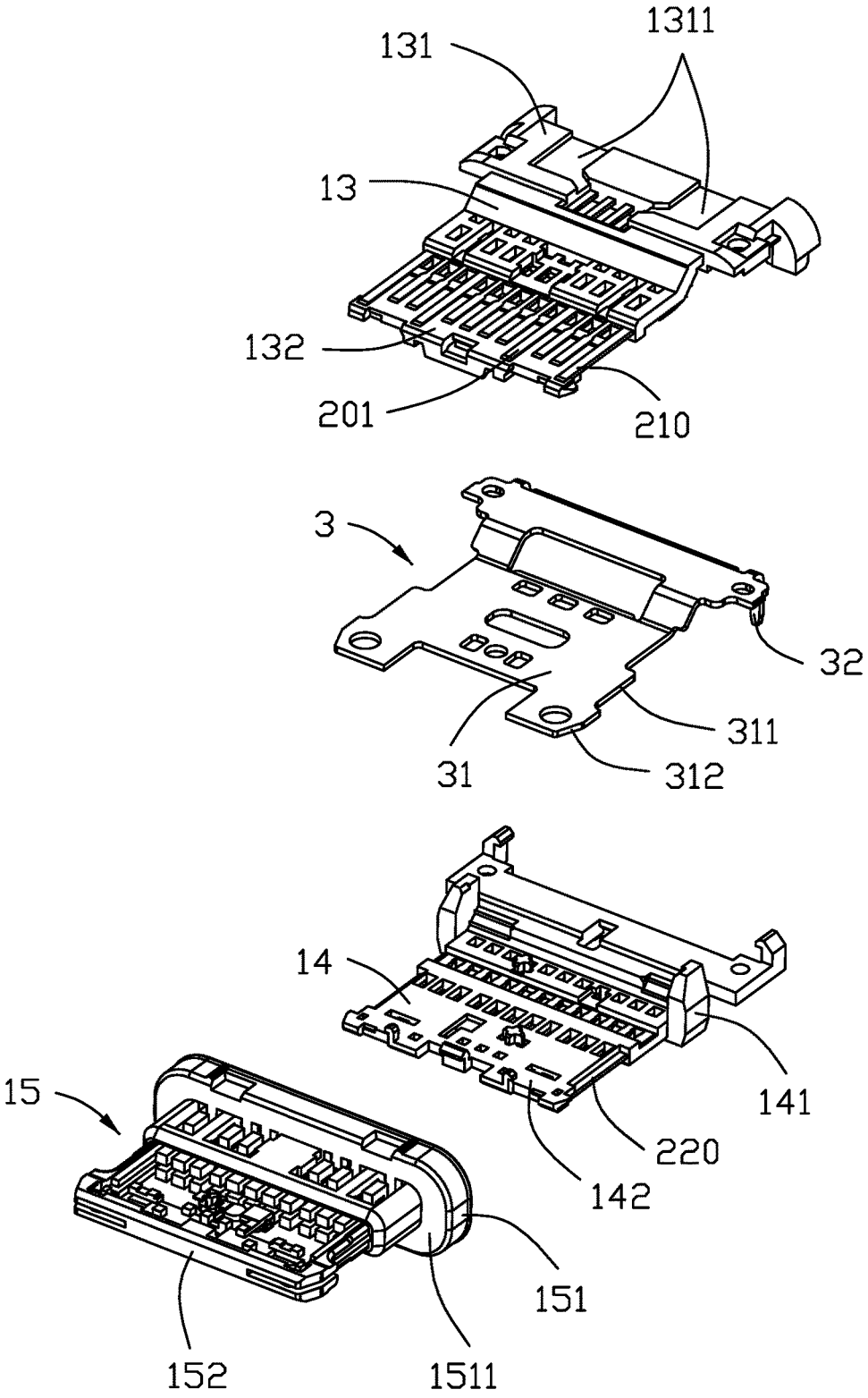
FIG. 10 is a further exploded view of FIG. 8.
Figure 11:
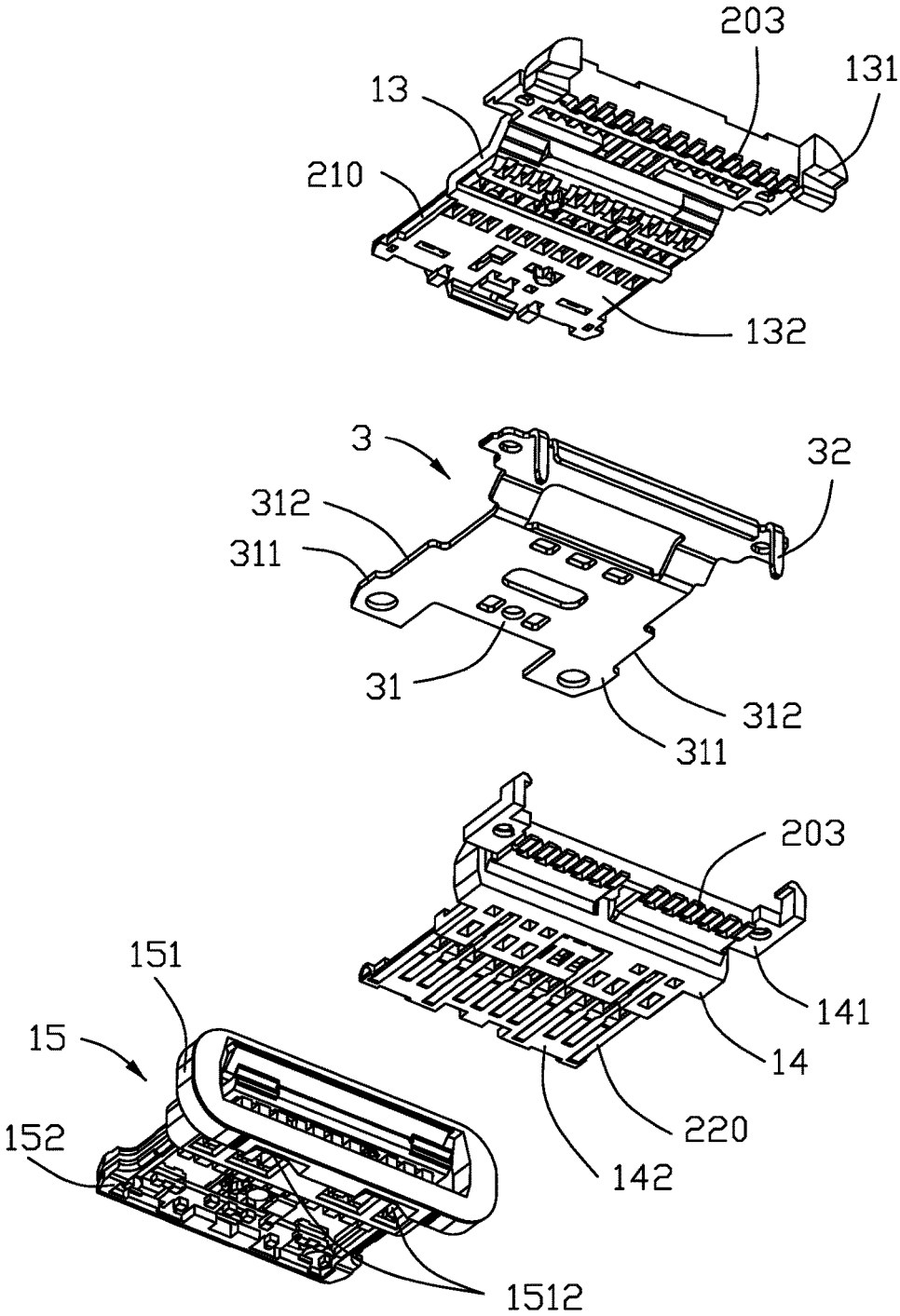
FIG. 11 is a further exploded view of FIG. 9.
Figure 12:
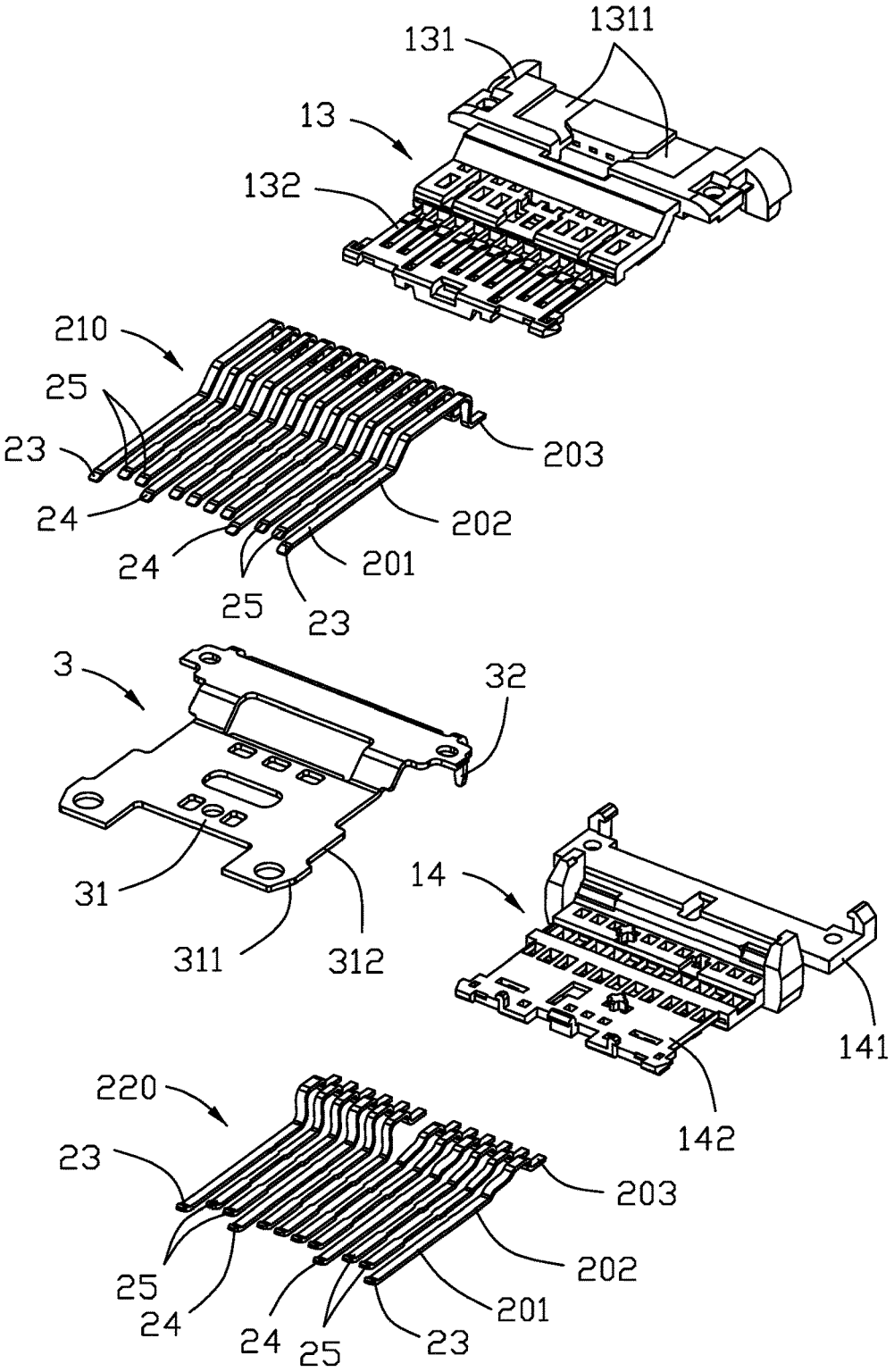
FIG. 12 is a further exploded view of FIG. 10.
Figure 13:
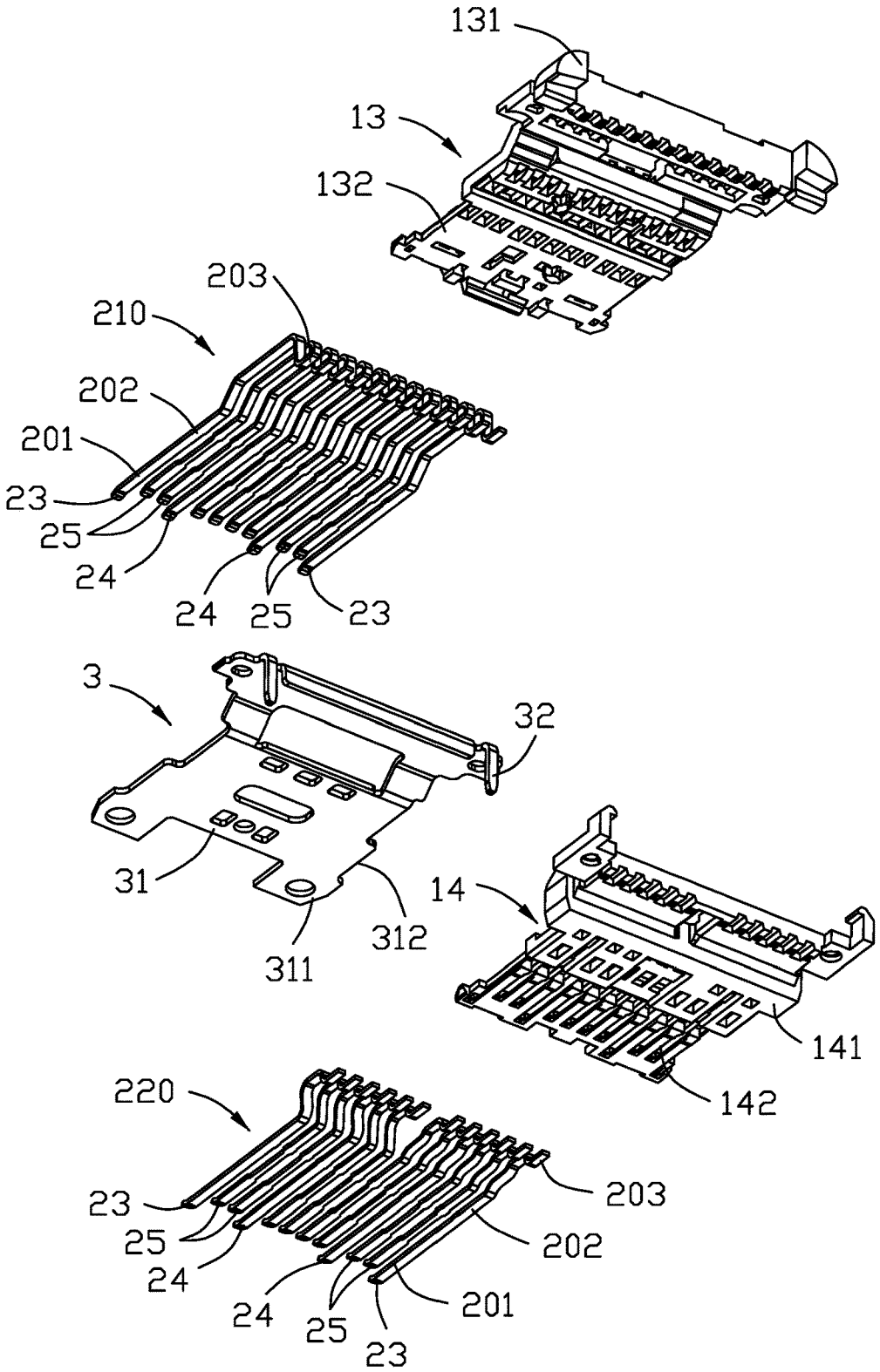
FIG. 13 is a further exploded view of FIG. 11.

Referring to FIGS. 1 to 14, an electrical connector 100 for mounting to a printed circuit board (not shown), comprises an insulative housing 1, a plurality of contacts 2 secured to the insulative housing 1, a shielding shell or inner shell 4 enclosing the insulative housing 1, and a metallic shield or outer shell 5 attached to the shielding shell 4. The electrical connector 100 may further comprise a metal piece 3.

The insulative housing 1 has a base 101 and a tongue 102. The base 101 has a pair of notches 1512 at a front face 1511 thereof and a pair of grooves 1311 at an upper face thereof. The tongue 102 has a pair of notches 1021 at two sides thereof. The insulative housing 1 is constructed of an upper body 13, a lower body 14, and an over-mold 15. The upper body 13, the lower body 14, and the over-mold 15 have a first base portion 131, a second base portion 141, and a third base portion 151, respectively, and have a first tongue portion 132, a second tongue portion 142, and a third tongue portion 152, respectively. The base portions 131, 141, and 151 constitute the base 101; the tongue portions 132, 142, and 152 constitute the tongue 102.

Referring to FIGS. 6-14, each contact 2 has a contacting portion 201, a soldering tail 203, and a connecting portion 202 therebetween. The plurality of contacts 2 include an upper row of contacts 210 and a lower row of contacts 220. The upper row of contacts 210 are reverse-symmetrically arranged with respect to the lower row of contacts 220 to enable dual-orientation mating with a complementary connector. In each row of the contacts 2, a longer contact 23 and another longer contact 25 are located by two sides of a pair of short contacts 24 at either end region.

The metal piece 3 has a main part 31 and a pair of legs 32. The main part 31 has portions 311 and 312. The metal piece 3 is disposed between the upper row of contacts 210 and the lower row of contacts 220.

Referring to FIGS. 8-12, the upper body 13 is insert molded with the upper row of contacts 210 and the lower body 14 is insert molded with the lower row of contacts 220.

Referring to FIGS. 1-7 and 14, the shielding shell 4 is metallic and includes a main part 41 and a rear extension 42. The main part 41 has a horizontal top wall 411, a horizontal bottom wall 412, and a pair of side walls 413, which together surround a receiving space 410. The top wall 411 has bulges 4111. The bottom wall 412 has a pair of holes 4121 which are elongate along a mating direction. The bottom wall 412 may also has a pair of stops 4122 for engaging the pair of notches 1512. The extension 42 has a pair of spring pieces 421, a plate 422, a pair of legs 423, and a pair of clips 424.

The metallic shield 5 has a main part 51, a pair of side walls 52, and a rear wall 53. The main part 51 has a pair of spring tangs 511 and one or more bulges 512. The spring tang 511 extends from an inner edge of an opening (not labeled) of the metallic shield 5 and rearward through the shielding shell hole 4121 into the receiving space 410 for grounding purpose. The bulge 512 is in contact with the bottom wall 412 of the shielding shell 4 and spaces the metallic shield main part 51 a distance 513 from the shielding shell bottom wall 412. The side wall 52 has a leg 521 for mounting to the printed circuit board (not shown).

Figure 14:
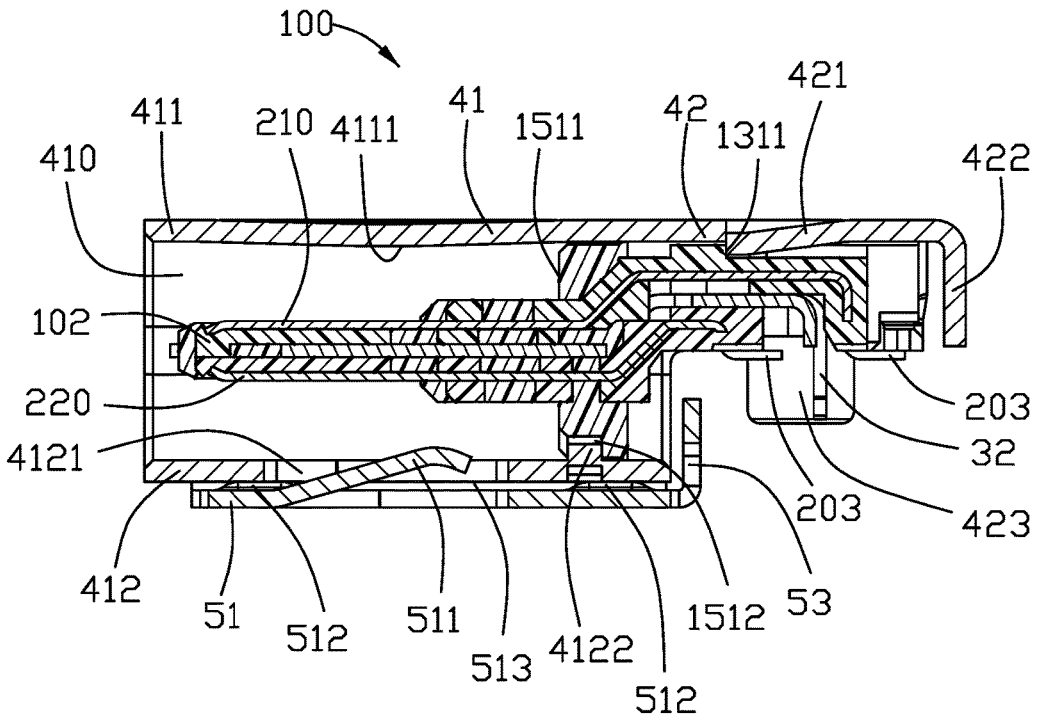
FIG. 14 is a cross-sectional view of the electrical connector taken along line A-A in FIG. 1.
Figure 14A:
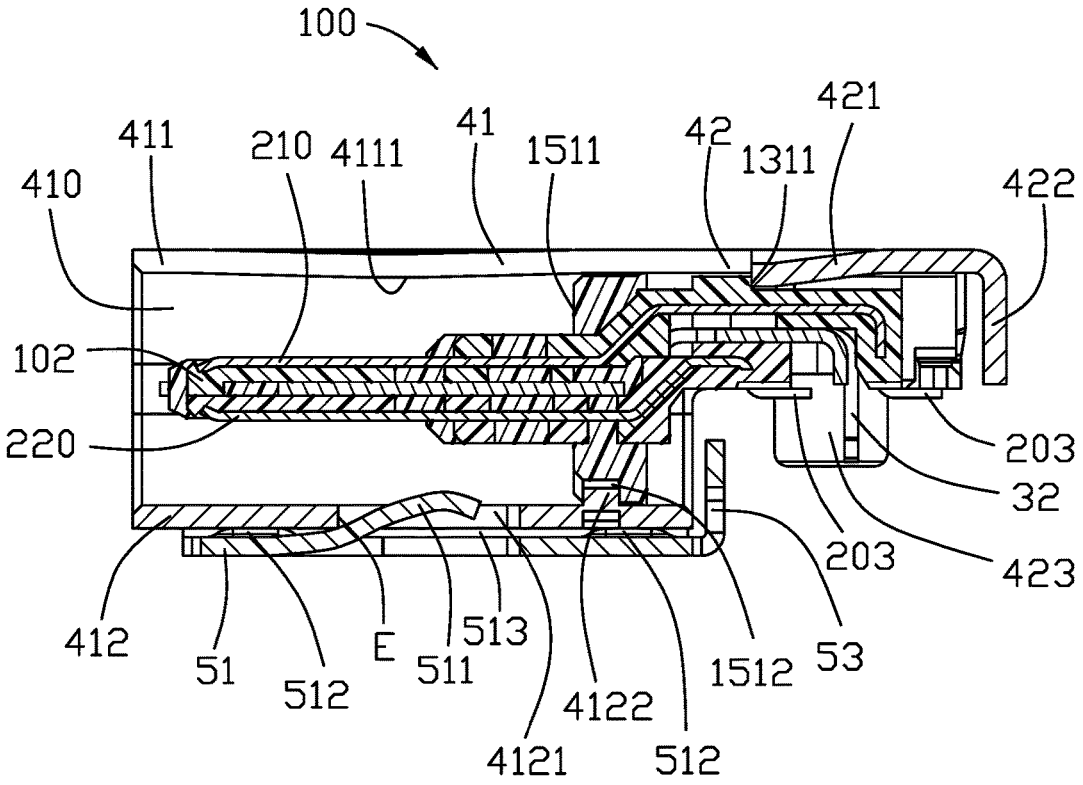
FIG. 14(A) is a cross-sectional view of the electrical connector of another embodiment.

By disposing the spring tang 511 on the metallic shield 5 rather than on the shielding shell 4 or by providing the bulge 512 to space the metallic shield 5 from the shielding shell 4, a length of the spring tang 511 is increased and therefore its property is improved. FIG. 14 (A) discloses an alternate embodiment in which the spring tang 511 is pressed and deflected by the edge E of the shielding shell hole 4121 in a preloaded manner during an un-mated condition so as to provide the smooth force variation during mating between the electrical connector and the complementary plug connector. Notably, the spring tang 511 is cantilevered and the edge E is approximate a root region of the spring tang 511. Notably, the preloaded spring tang functions more stable than the freely extending one in some situations advantageously. In both embodiments, the bulges 4111 form no opening thereabouts and are essentially more rigid than the spring tangs 511. This is the reason why the spring tangs 511 are desired to extend from the outer shell with more dimension/space for compensating the flexibility thereof.

What is claimed is:

1. An electrical connector comprising:

an insulative housing having a base and a tongue defining opposite upper and lower surfaces in a vertical direction and extending in a front-to-back direction perpendicular to said vertical direction;

a plurality of contacts secured to the housing and exposed upon at least one of said upper and lower surfaces of the tongue;

a metallic inner shell including a tubular structure thereof and defining a pair of horizontal walls opposite to each other in said vertical direction, and a pair of side walls opposite to each other in a transverse direction perpendicular to both said vertical direction and said front-to-back direction, said pair of horizontal walls and said pair of side walls commonly forming a receiving space in which the tongue extends horizontally;

one of the pair of horizontal walls forming bulges extending into the receiving space in said vertical direction, and the other of said pair of horizontal walls forming through holes in the vertical direction; and a metallic outer shell attached to the other of said pair of horizontal walls of the inner shell and including a pair of legs for mounting to a printed circuit board; wherein said outer shell further includes a plurality of spring tangs each extending from an inner edge of an opening thereof and through the corresponding through hole in the other of said pair of the horizontal walls and further into the receiving space; wherein said outer shell forms a plurality of bulges to abut against the other of said pair of horizontal walls.

2. The electrical connector as claimed in claim 1, wherein the spring tangs freely extend through the corresponding through holes, respectively.

3. The electrical connector as claimed in claim 1, wherein each of said spring tangs abuts against an edge of the corresponding through hole in a preloaded manner.

4. An electrical connector comprising:

an insulative housing having a base and a tongue defining opposite upper and lower surfaces in a vertical direction and extending in a front-to-back direction perpendicular to said vertical direction;

a plurality of contacts secured to the housing and exposed upon at least one of said upper and lower surfaces of the tongue;

a metallic inner shell including a tubular structure thereof and defining a pair of horizontal walls opposite to each other in said vertical direction, and a pair of side walls opposite to each other in a transverse direction perpendicular to both said vertical direction and said front-to-back direction, said pair of horizontal walls and said pair of side walls commonly forming a receiving space in which the tongue extends horizontally;

one of the pair of horizontal walls forming bulges extending into the receiving space in said vertical direction, and the other of said pair of horizontal walls forming through holes in the vertical direction; and a metallic outer shell attached to the other of said pair of horizontal walls of the inner shell and including a pair of legs for mounting to a printed circuit board; wherein said outer shell further includes a plurality of spring tangs each extending from an inner edge of an opening thereof and through the corresponding through hole in the other of said pair of the horizontal walls and further into the receiving space; wherein each of said spring tangs abuts against an edge of the corresponding through hole in a preloaded manner; wherein said spring tang is cantilevered and said edge is approximate a root region of the corresponding spring tang.

5. The electrical connector as claimed in claim 4, wherein said outer shell forms a plurality of bulges to abut against the other of said pair of horizontal walls.

* * * * *